US005992691A

United States Patent [19]

Post et al.

[11] Patent Number: 5,992,691

[45] Date of Patent: Nov. 30, 1999

[54] DISPENSING APPARATUS FOR FLUID CONTAINED IN FLEXIBLE PACKAGES

[75] Inventors: Johannes Hermanus Nicolaas Post, Sassenheim; Michiel Jacobus Johannes Langeveld, Zoetermeer; Johannes Hendrikus Mink, Voorhout, all of Netherlands

[73] Assignee: Fluid Management, Wheeling, Ill.

[21] Appl. No.: 08/888,826

[22] Filed: Jul. 7, 1997

[51] Int. Cl.[6] ..... B67D 5/00

[52] U.S. Cl. ..... 222/82; 222/144; 222/148; 222/383.1

[58] Field of Search ..... 222/82, 342, 148, 222/149, 383.1, 144, 325, 375, 402.2

[56] References Cited

U.S. PATENT DOCUMENTS

| | | | |
|---|---|---|---|
| 3,035,737 | 5/1962 | Speas | 222/82 |
| 5,078,302 | 1/1992 | Hellenberg | 222/144 |
| 5,105,988 | 4/1992 | Knickerbocker | 222/148 |
| 5,358,146 | 10/1994 | Stull | 222/148 |
| 5,791,519 | 8/1998 | Van Marcke | 222/82 |

FOREIGN PATENT DOCUMENTS 0 798 264 A1 12/1996 European Pat. Off. .

*Primary Examiner*—Philippe Derakshani
*Attorney, Agent, or Firm*—Hill & Simpson

[57] ABSTRACT

A dispensing system for dispensing viscous fluids from flexible packages is provided. The flexible package is connected to a pump by way of a conduit. A buffer system may be provided which results in an emptying of the flexible package of fluid first prior to the emptying of the buffer system. A valve may be provided to isolate the flexible package thereby enabling the flexible package to be removed and replaced with a full package while the pump continues to draw fluid out of the buffer system. Accordingly, the flexible package of fluid may be replaced without interruption of the dispenser. A self-cleaning closure for the outlet to the dispenser may be provided to keep the outlet clean.

29 Claims, 3 Drawing Sheets

DISPENSING APPARATUS FOR FLUID CONTAINED IN FLEXIBLE PACKAGES

BACKGROUND OF THE INVENTION

The present invention relates to an apparatus for dispensing viscous fluids and, more particularly, to dispensing viscous fluids contained in flexible packages.

In many industries, a thick or viscous fluid is added to a mixture in small amounts. Because only a small amount of the viscous liquid is required for each final product, a container or reservoir of the viscous fluid must be designed so that the viscous fluid is not exposed to air for prolonged periods of time. Otherwise, the viscous fluid may dry making it difficult to mix with other fluids or liquids or resulting in the viscous fluid having to be reprocessed or wasted.

Another problem associated with the dispensing of viscous fluids is the tendency of the fluids to leave a residue or crust at the dispenser outlet. The residue can build up and potentially block the outlet or otherwise interfere with the discharge of fluid through the outlet.

Still another problem associated with the dispensing of viscous fluids is the exposure of the viscous fluid to air through the outlet. The invasion of air through the outlet can result in the build up of residue and crust inside the outlet which will interfere with the flow of fluid through the outlet and which could possibly result in blockage of the outlet.

Accordingly, there is a need for an improved dispensing apparatus for viscous fluids which minimizes the exposure of the fluid to air during the dispensing of the fluid and which maintains the outlet port in a clean condition and substantially free of residue.

SUMMARY OF THE INVENTION

The present invention provides a solution to the aforenoted needs in the form of a fluid dispenser that utilizes a flexible package as the initial reservoir of viscous fluid. The flexible package is connected to a pump by a conduit. The pump may be a piston-type pump having a cylinder and a piston. A lower end of the piston is disposed in the cylinder and an upper end of the piston detachably engages an actuator.

In operation, the actuator moves the piston upward in an intake stroke to draw fluid from the flexible package, through the conduit and into the cylinder. In a dispense stroke, the actuator pushes the piston downward which forces fluid out of the cylinder through an outlet. In the event the supply of viscous fluid in the flexible package becomes depleted, an intake stroke of the actuator will create a low pressure atmosphere within the cylinder, conduit and flexible package. As a result of the low pressure atmosphere, the piston is drawn downward and becomes disengaged from the actuator. Hence, the dispenser has an automatic shut off when the supply of viscous fluid in the flexible package is depleted.

In an embodiment, the dispenser is equipped with a buffer reservoir which is in communication with the flexible package and, preferably, disposed vertically below the flexible package so that the fluid flows downward through a portion of the conduit into the buffer reservoir under the force of gravity. During an intake stroke of the pump, fluid may be drawn from the flexible package, the buffer reservoir or both. In the event the flexible package is empty and the buffer reservoir is full or at least partially full, fluid is drawn from the buffer reservoir during an intake stroke.

In an embodiment, a valve is provided in the section of conduit extending between the flexible package and the buffer reservoir so that the flexible package may be isolated. When the valve is closed, an empty flexible package may be removed and replaced with a full flexible package, at the same time the pump is operating and withdrawing fluid from the buffer reservoir. Hence, the continuity of the dispense operation is not interrupted when an empty flexible package is replaced with a new full flexible package.

In an embodiment, the conduit comprises a T-section of conduit having a first section that extends between the flexible package and a buffer reservoir and a second section extending from the first section of conduit to the pump. In an embodiment, the valve is provided in the first section of conduit between the point where the second section of conduit is connected to the first section of conduit and the flexible package for isolating the flexible package and enabling an empty flexible package to be replaced with a full flexible package without interrupting the operation of the pump.

In an embodiment, an "active" buffer reservoir is provided along the conduit between the flexible package and the pump. In such an embodiment, the active buffer reservoir comprises a piston pump with a lower end of a piston disposed in a cylinder and an upper end of a piston disposed above the cylinder. A spring biases the piston upward and viscous fluid is disposed in the buffer cylinder below the buffer piston. In the event the flexible package becomes empty and a low pressure environment is created in the main pump cylinder, conduit, flexible package and buffer cylinder, the buffer piston will be drawn downward against the bias of the spring to supply fluid from the buffer cylinder to the main pump.

In an embodiment, a valve is disposed in the conduit between the buffer reservoir and the flexible package so that the flexible package can be isolated during operation of the main pump which enables an empty flexible package to be removed and replaced with a full flexible package without interrupting operation of the main pump.

In an embodiment, a plurality of dispensers made in accordance with the present invention as set forth above are disposed on a rotary table along an outer periphery of the table. Depending on the location of the pump and outlet, a receiving station is disposed below the table along the periphery of the table or along an inside portion of the table for receiving fluid dispensed from one of the dispensers. The table can then be rotated to position any one of the dispensers mounted to the table above the receiving vessel.

In an embodiment, the outlets of the dispensers of the present invention include a scraper device that is pivotally connected to the outlet and which scrapes the outlet at the opening through which the fluid passes thereby removing film and residue that accumulates on the outlet opening after viscous fluid is passed therethrough.

In an embodiment, the outlets of the dispensers of the present invention further include a closure that is pivotally attached to the outlet which includes a main body for sealingly engaging the hole in the outlet through which the fluid passes. In an embodiment, a scraper is mounted onto the main body of the closure which scrapes the outlet at the opening or hole through which the fluid passes resulting in a removal of dried fluid residue or crust which may have accumulated on the dispenser outlet.

It is therefore an advantage of the present invention to provide an improved dispenser for dispensing fluids provided in flexible packages.

Another advantage of the present invention is that it provides a dispenser for dispensing fluids provided in flexible packages which enables empty flexible packages or partially empty flexible packages to be removed and replaced with full flexible packages without interrupting the operation of the dispenser pump.

Another advantage of the present invention is that it provides a dispenser for dispensing viscous fluid from flexible packages that limits the exposure of the fluid to ambient air.

Yet another advantage of the present invention is that it provides an improved dispensing station for dispensing viscous fluid from flexible packages.

Still another advantage of the present invention is that it provides an improved closure for an outlet of a dispenser of viscous fluid which removes dried fluid and residue from the outlet.

Other objects and advantages of the invention will become apparent upon reading the following detailed description and appended claims, and upon reference to the accompanying drawings.

BRIEF DESCRIPTION OF THE DRAWINGS

For a more complete understanding of the invention, reference should now be made to the embodiments illustrated in greater detail in the accompanying drawings and described below by way of an examples of the invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
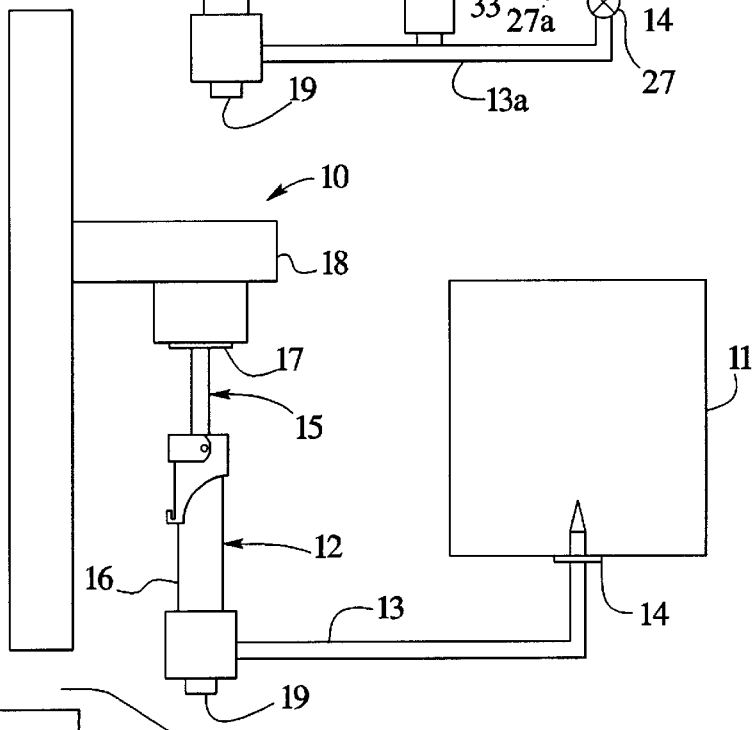
FIG. 1 is a partly schematic elevational view of a dispenser made in accordance with the present invention.

Turning first to FIG. 1, a dispenser 10 is illustrated which connects a flexible packaging or bag 11 that contains fluid to a piston-type pump 12. The conduit 13 connects the flexible package 11 to the pump 12. The conduit 13 is attached to the packaging 11 with a fitting 14 that makes it easy to connect and disconnect the package 11 from the conduit 13. The pump 12 includes a piston 15 having a lower end (not shown) disposed within the cylinder 16 and an upper end 17 that is detachably connected to an actuator arm 18 which moves the piston 15 upward during an intake stroke and downward during a discharge stroke. Fluid is discharged through the outlet 19.

In operation, a flexible package 11 is mounted onto the conduit 13 as shown in FIG. 1. The package 11 is full of viscous fluid to be dispensed through the outlet 19. The actuator arm 18 draws the piston 15 upward during an intake stroke which causes fluid to flow from the package 11, through the conduit 13 and into the cylinder 16. During a discharge stroke, the actuator arm 18 pushes the piston 15 downward causing the lower end (not shown) of the piston 15 to force fluid out of the cylinder 16 and through the outlet 19.

Figure 2:
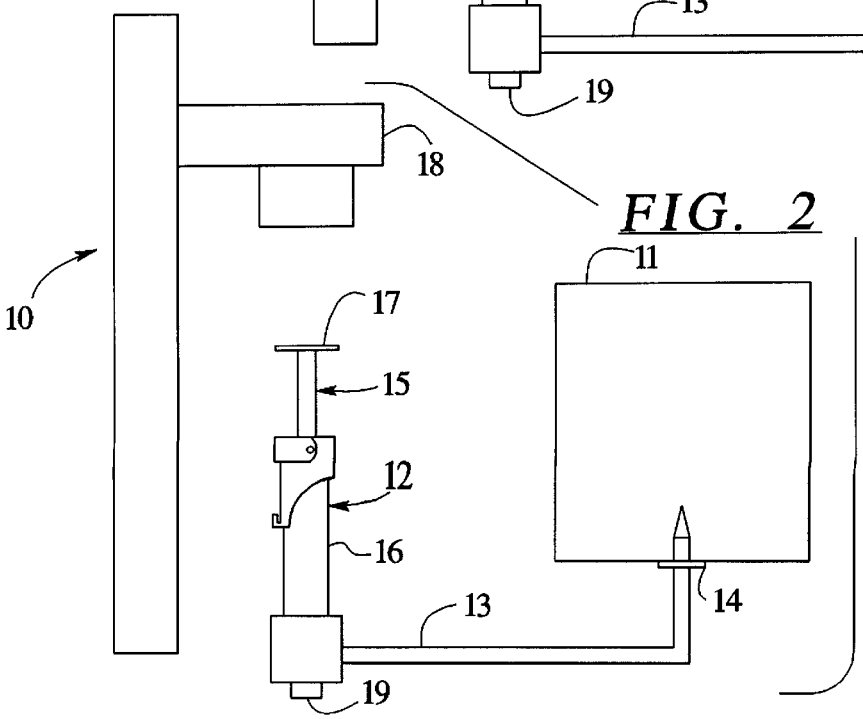
FIG. 2 is an elevational view of the dispenser first shown in FIG. 1 with the actuator detached from the piston of the pump.

In the event the package 11 becomes empty or nearly empty, the upward movement of the actuator arm 18 during an intake stroke results in the separation of the actuator arm 18 from the upper end 17 of the piston 15 as shown in FIG. 2. Specifically, when the package 11 is empty and an intake stroke is carried out, a low pressure or near vacuum environment is created in the cylinder 16, conduit 13 and package 11. This low pressure environment causes the piston 15 to be drawn downward into the cylinder 16 thereby resulting in separation between the upper end 17 of the piston 15 and the actuator arm 18 as shown in FIG. 2.

Figure 3:
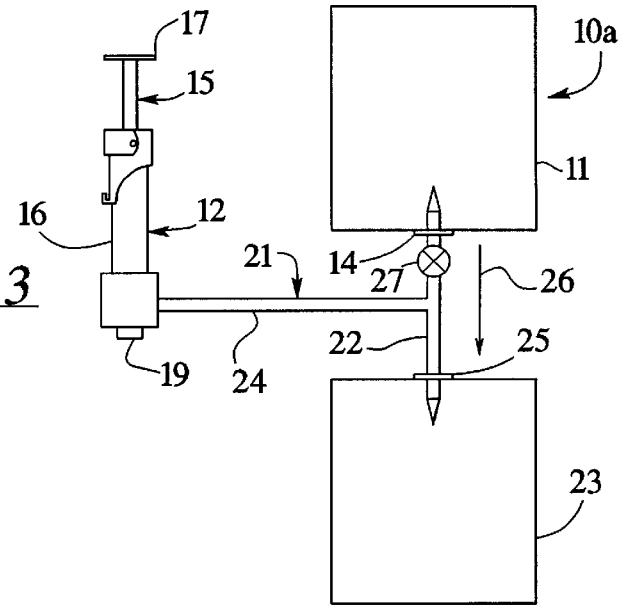
FIG. 3 is a partly schematic elevational view of another dispenser made in accordance with the present invention.

To alleviate the problem of the package 11 running out of fluid, a buffer may be provided as shown in FIG. 3. Specifically, a conduit 21 is provided that is T-shaped with a first section 22 connecting the package 11 with the package or buffer reservoir 23. A second section 24 connects the first section 22 to the pump 12. In the embodiment illustrated in FIG. 3, the buffer reservoir 23 is made of a material similar to the package 11 and is connected to the conduit section 22 with a fitting 25.

The operation of the dispenser 10*a* illustrated in FIG. 3 is as follows. Preferably, the buffer reservoir 23 is disposed vertically below the flexible package 11. This arrangement will allow fluid to flow under the force of gravity in the direction of the arrow 26 through the conduit section 22 and down into the buffer reservoir 23. During an intake stroke, fluid may flow from either the package 11 or the buffer reservoir 23, or both, through the conduit section 24 and into the cylinder 16. In the event all of the fluid has migrated from the package 11 to the buffer reservoir 23, only fluid from the reservoir 23 will travel through the conduit section 22 and conduit section 24 into the cylinder 16 during an intake stroke. When the package 11 is empty, the valve 27 disposed in the conduit section 22 may be closed thereby isolating the package 11. The package 11 may then be removed and replaced with a full package 11 without interrupting the operation of the pump 12. Accordingly, assuming the package 11 is replaced prior to the exhaustion of the fluid from the buffer reservoir 23, there will be no interruption in the operation of the dispenser 10*a* and the upper end 17 of the piston 15 will not become disengaged from the actuator arm 18 (not shown in FIG. 3; see FIGS. 1 and 2).

Figure 4:
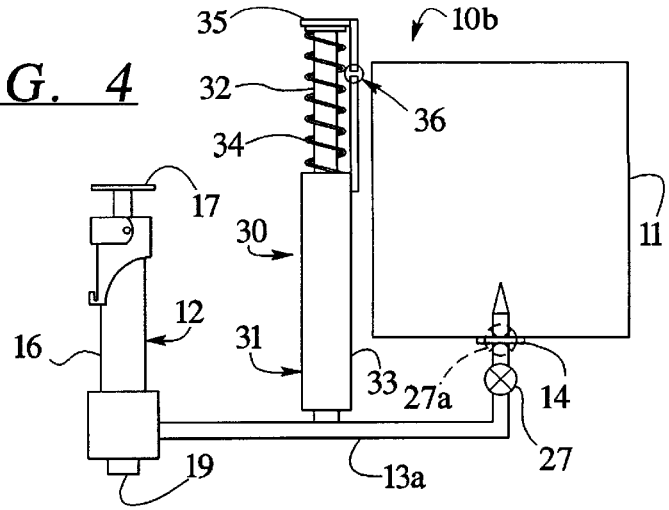
FIG. 4 is a partly schematic elevational view of another dispenser made in accordance with the present invention.

A different buffer system is illustrated in FIG. 4. Specifically, a flexible package 11 is connected to a pump 12 by way of a conduit 13*a* which differs from the conduit 13 shown in FIGS. 1 and 2 due to the placement of the valve 27 adjacent to the package 11 and the connection of the buffer system 30 between the package 11 and the pump 12. The buffer system 30 shown in FIG. 4 is an active buffer as opposed to the passive buffer reservoir 23 shown in FIG. 3. The buffer system 30 comprises a piston pump 31 which includes a piston 32, the lower end of which (not shown) is disposed inside a cylinder 33. A spring 34 is disposed between the cylinder 33 and the upper end 35 of the piston 32. The spring biases the piston 32 upward and the cylinder 33 is substantially full of fluid which is held in reserve until the package 11 becomes empty or near empty due to the biasing effect of the spring 34 on the piston 32. When the package 11 becomes empty, a low pressure environment is created in the cylinder 16 of the pump 12, the conduit 13*a* and the package 11. This low pressure environment causes fluid to be drawn out of the cylinder 33 and the suction effect eventually draws the piston 32 downward as the buffer system 30 now provides fluid to the pump 12 during an intake stroke of the pump 12. When fluid is being drawn from the buffer system 30, the valve 27 may be closed and the empty package 11 may be replaced with a full package 11. After replacement of the package 11, the valve may then be reopened to draw fluid from the package 11 into the conduit 13*a* during an intake stroke of the pump 12.

Preferably, a signal in the form of a contact switch 36 or other suitable signal is provided when the buffer system 30 of the dispenser 10*b* is activated. Then, the valve 27 may be closed automatically or manually and an operator may be notified that it is time to replace the package 11. Any suitable signal or alarm may be provided. Further, a signal or alarm may be provided for the passive buffer system shown in FIG. 3 which alerts an operator as to when fluid is being drawn only from the buffer reservoir 23 as opposed to the flexible package 11. Upon recognition of the alarm or signal, the operator will know that it is safe to close the valve 27 as shown in FIG. 3 and replace the flexible package 11 with a fresh package. A controller (not shown) may be used to notify the operator to change the main package 11. A software program may be employed to keep track of the amounts of viscous fluid dispensed. The software program may also alert the operator as to when the supply of fluid in the flexible package 11 and/or buffer reservoir 23 becomes depleted.

Figure 10:
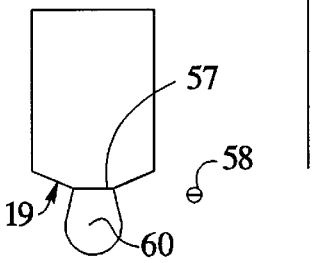
FIG. 10 is an elevational view of an outlet of a fluid dispenser equipped with a scraper.
Figure 11:
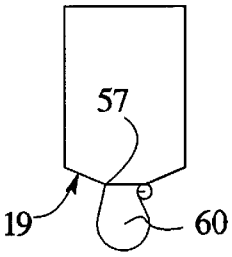
FIG. 11 is another elevational view of the outlet and scraper shown in FIG. 10 with the scraper shown engaging the outlet.
Figure 12:
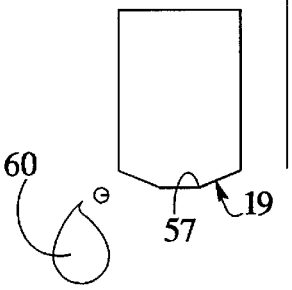
FIG. 12 is another elevational view of the outlet and scraper shown in FIG. 10 particularly illustrating the scraper just after it has engaged the outlet.
Figure 13:
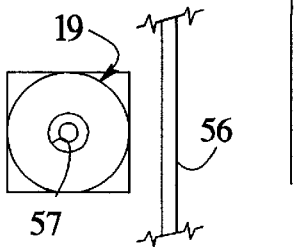
FIG. 13 is a bottom view of the outlet and scraper shown in FIG. 10.
Figure 14:
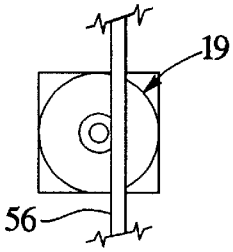
FIG. 14 is a bottom view of the outlet and scraper shown in FIG. 11.
Figure 15:
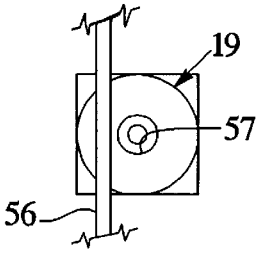
FIG. 15 is a bottom view of the outlet and scraper shown in FIG. 12.
Figure 5:
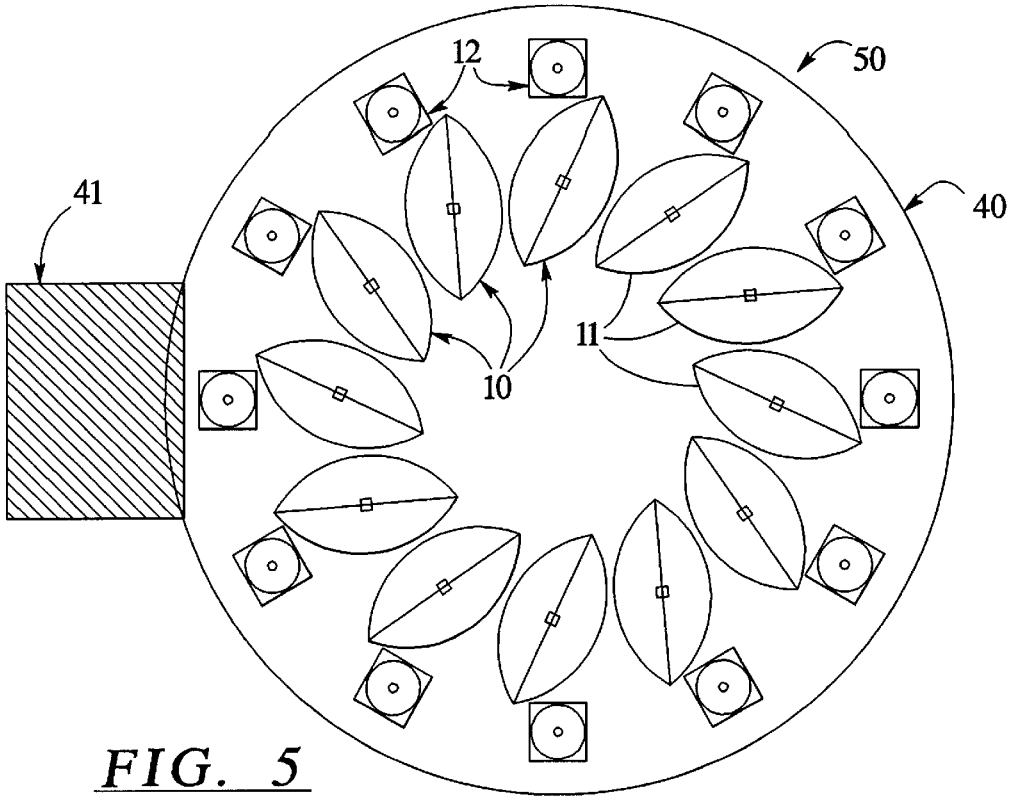
FIG. 5 is a plan view of a rotary dispensing station made in accordance with the present invention.
Figure 6:
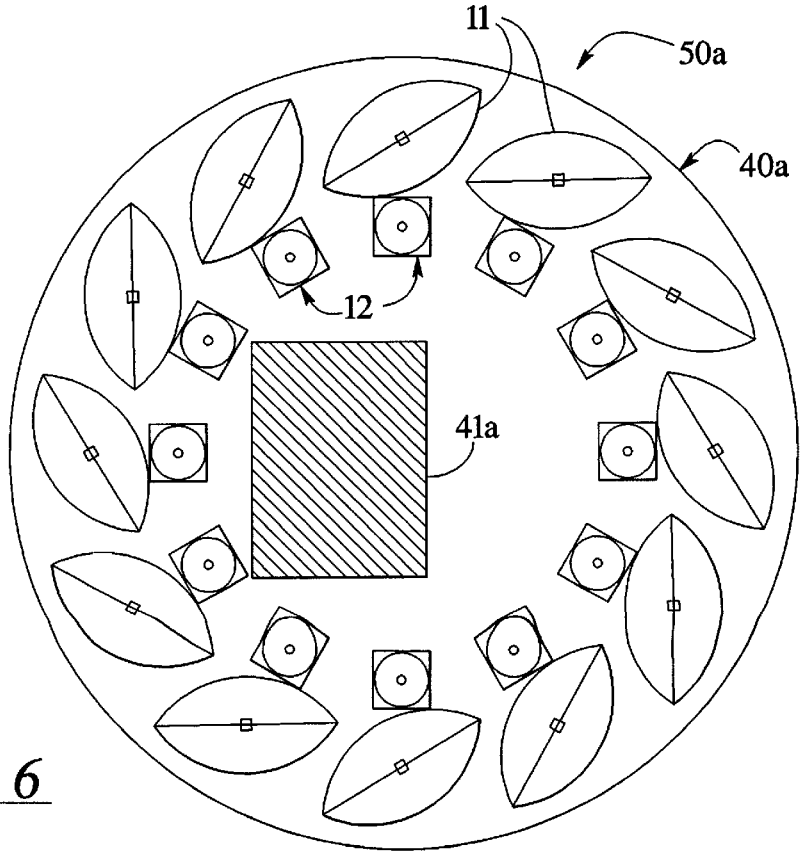
FIG. 6 is a plan view of another rotary dispensing station made in accordance with the present invention.

A plurality of dispense systems like those shown at 10 in FIGS. 1 and 2, 10*a* in FIG. 3 and 10*b* in FIG. 4 may be mounted onto a rotary table 40 as shown in FIG. 5. The table 40 may be rotated past a collection vessel 41 which can receive incremental amounts of fluid from any one of the dispensers 10 mounted to the table 40. The system 50 and 50*a* as shown in FIGS. 5 and 6 are particularly useful for those applications where small amounts of fluid are drawn from the packages 11 during the manufacture of a mixture, such as paint, ink or other colorant. The table may be rotated so that precise amounts of material may be drawn out from the packages 11 and added to the containment vessel 41 in an efficient method. With respect to the system 50*a* shown in FIG. 6, the containment vessel 41 a may be disposed underneath a central portion of the table 40*a* as opposed to the outer periphery as shown in FIG. 5. The outlets for the dispensers 10 will typically be disposed below the rotary tables 40 and 40*a*.

Figure 7:
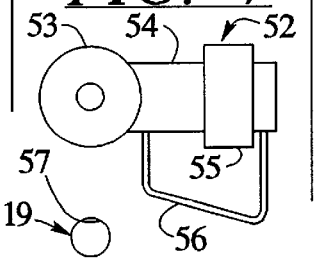
FIG. 7 is a bottom view of a closure for an outlet of a dispenser made in accordance with the present invention, particularly illustrating the closure in the open position.
Figure 8:
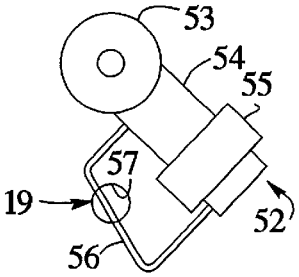
FIG. 8 is another bottom view of the closure first shown in FIG. 7 between the open and closed positions.
Figure 9:
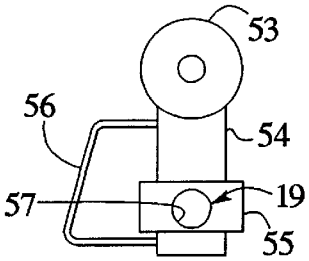
FIG. 9 is another bottom plan view of the closure first shown in FIG. 7 in the closed position.

Various configurations of the outlet 19 are shown in FIGS. 7 through 15. Referring to FIGS. 7–9, a closure 52 is attached to the pump 12 by way of a pivotal bracket 53. The closure 52 includes a main body 54 which accommodates a sealing ring 55 that is disposed over the outlet 19 as shown in FIG. 9 when the closure 52 is in the closed position. Mounted to the main body 54 is a scraper bar 56 which scrapes the outlet 19 and removes residue and dried fluid from the outlet 19 during each closure thereby keeping the outlet 19 in a clean, relatively residue free condition. As noted above, viscous fluids can dry and coat the outlet ultimately clogging the hole 57 through which the fluid passes.

Turning to FIGS. 10–15, a scraper 58 may be provided which pivots across the hole 57 in the outlet 19 through which the fluid 60 passes. Like the scraper 56 shown in FIGS. 7–9, the scraper 58 keeps the hole 57 and outlet 19 in a clean, relatively residue free condition and prevents clogging.

From the above description, it is apparent that the objects of the present invention have been achieved. While only certain embodiments have been set forth, alternative embodiments and various modifications will be apparent from the above description to those skilled in the art. For example, the buffer systems shown at 23 and 30 may be combined. Also, the buffer systems may be utilized in the rotary systems 50 and 50*a* shown in FIGS. 5–6. Further, the outlet closure configurations shown at 52 and 58 in FIGS. 7–15 may also be incorporated into any of the dispensers shown at 10 in FIGS. 1 and 2, 10*a* in FIG. 3 or 10*b* in FIG. 4. Still further, pumps other than the piston-type pumps 12 and 31 may be employed and the actuation system may be varied to include configurations other than the actuating arm shown at 18 in FIGS. 1 and 2. These and other alternatives are considered equivalents and within the spirit and scope of the present invention.

What is claimed is:

1. A fluid dispenser comprising:

a flexible package connected to a first pump by a conduit, the flexible package containing a supply of fluid to be dispensed, the first pump comprising a first cylinder and a first piston, the first piston comprising a lower end and an upper end, the lower end of the first piston being slidably accommodated in the first cylinder, the upper end of the first piston detachably engaging an actuator, when the fluid is disposed in the package, upward movement of the actuator results in upward movement of the first piston and a drawing of fluid from the package, through the conduit and into the first cylinder, when the supply of fluid in the package is depleted, upward movement of the actuator results in an initial upward movement of the first piston which results in a reduction in pressure in the first cylinder, conduit and package until the pressure is reduced to a level where the first piston is urged downward by reduced pressure in the first cylinder causing the upper end of the first piston to become detached from the actuator.

2. The dispenser of claim 1 wherein the conduit comprises a section connecting a buffer reservoir to the flexible package, the buffer reservoir being disposed vertically below the flexible package so that fluid flows downward from the flexible package through said section of the conduit to the buffer reservoir, and when the supply of fluid in the flexible package is depleted, upward movement of the actuator results in a drawing of fluid from the buffer reservoir.

3. The dispenser of claim 2 further comprising a valve disposed in the section of the conduit disposed between the flexible package and the buffer reservoir, closure of the valve isolating the flexible package from the buffer reservoir and first pump thereby enabling the flexible package to be removed from the dispenser either replaced or refilled when the flexible package is empty.

4. The dispenser of claim 3 further comprising a coupling that connects the conduit to the flexible package, the coupling comprising a valve for isolating the flexible package from the buffer reservoir and first pump thereby enabling the flexible package to be removed from the dispenser either replaced or refilled when the flexible package is empty.

5. The dispenser of claim 4 further comprising a valve disposed in the first section of the conduit between the flexible package and the second section of the conduit, closure of the valve isolating the flexible package from the buffer reservoir and the first pump thereby enabling the flexible package to be removed from the dispenser either replaced or refilled when the flexible package is empty.

6. The dispenser of claim 1 further comprising a buffer reservoir connected to the conduit between the flexible package and the first pump, the buffer reservoir comprising a buffer supply of fluid, the buffer supply of fluid being isolated from the conduit when fluid is present in the flexible package, when the supply of fluid in the flexible package is depleted, upward movement of the actuator results in an initial upward movement of the first piston which results in a reduction in pressure in the first cylinder, conduit and package until the pressure is reduced to a level where fluid is released from the buffer reservoir into the conduit.

7. The dispenser of claim 6 wherein the buffer reservoir comprises a buffer pump in communication with the buffer supply of fluid and the conduit, the buffer pump being inactive when fluid is present in the flexible package, the buffer pump being activated when the supply of fluid in the flexible package is depleted and a low pressure atmosphere is created in the conduit by upward movement of the actuator.

8. The dispenser of claim 1 further comprising a buffer reservoir connected to the conduit between the flexible package and the first pump, the buffer reservoir comprising a buffer cylinder connected to a buffer piston comprising an upper end and a lower end, the lower end of the buffer piston being disposed in the buffer cylinder, the upper end of the buffer piston being biased above the buffer cylinder by spring disposed between the buffer cylinder and the upper end of the buffer piston, a buffer supply of fluid being disposed in the buffer cylinder below the lower end of the buffer piston, when the supply of fluid in the flexible package is depleted, upward movement of the actuator results in an initial upward movement of the first piston which results in a reduction in pressure in the first cylinder, conduit and package until the pressure is reduced to a level where the buffer piston is urged downward causing the lower end of the buffer piston to follow fluid into the conduit.

9. The dispenser of claim 1 wherein the first cylinder is in communication with an outlet for discharging the fluid, the outlet comprising a hole through which the fluid passes, the outlet being pivotally connected to a scraper for removing excess fluid from the outlet after fluid has passed through the hole.

10. The dispenser of claim 1 wherein the first cylinder is in communication with an outlet for discharging the fluid, the outlet comprising a hole through which the fluid passes, the outlet being pivotally connected to a closure for covering the hole and limiting exposure of the fluid disposed in the first cylinder to air, the pivotal closure further comprising a main body for engaging the hole and a scraper for removing excess fluid from the outlet prior to the engagement of the hole with the main body.

11. A dispenser for dispensing a supply of fluid, the dispenser comprising:

a flexible package accommodating the primary supply of fluid, the flexible package being connected to a first conduit, the first conduit connecting the flexible package to a buffer reservoir, the first conduit being connected to a second conduit at a point disposed between the flexible package and the buffer reservoir, the second conduit being connected to a cylinder, the cylinder being connected to a piston comprising a lower end and an upper end, the lower end being slidably accommodated in the cylinder, the upper end being detachably connected to an actuator, the cylinder being in communication with an outlet, the buffer reservoir being disposed vertically below the flexible package so that fluid flows downward from the flexible package through the first section of the conduit to the buffer reservoir, when the fluid is disposed in the flexible package, upward movement of the actuator results in upward movement of the piston and a drawing of fluid from the flexible package, through a portion of the first conduit and into the cylinder below the lower end of the piston, when the supply of fluid in the flexible package is depleted and fluid is disposed on the buffer reservoir, upward movement of the actuator results in a drawing of fluid from the buffer reservoir, through a portion of the first section of the conduit, through the second section of conduit and into the cylinder, when the fluid in the flexible package and buffer reservoir is depleted, upward movement of the actuator and piston results in a reduction in pressure in the cylinder, the conduit and the package until the pressure is reduced to a level where the piston is drawn downward causing the upper end of the piston to become detached from the actuator.

12. A fluid dispenser comprising:

a flexible package connected to a first pump by a conduit, the flexible package containing a supply of fluid to be dispensed, the first pump comprising a first cylinder and a first piston, the first piston comprising a lower end and an upper end, the lower end of the first piston being slidably accommodated in the first cylinder, the upper end of the first piston detachably engaging an actuator, the dispenser further comprising a buffer reservoir connected to the conduit between the flexible package and the first pump, the buffer reservoir comprising a buffer pump comprising a buffer cylinder connected to a buffer piston comprising an upper end and a lower end, the lower end of the buffer piston being disposed in the buffer cylinder, the upper end of the buffer piston being biased above the buffer cylinder by spring disposed between the buffer cylinder and the upper end of the buffer piston, a buffer supply of fluid being disposed in the buffer cylinder below the lower end of the buffer piston, when fluid is disposed in the flexible package, upward movement of the actuator results in upward movement of the first piston and a drawing of fluid from the flexible package, through the conduit and into the first cylinder, when the supply of fluid in the flexible package is depleted, upward movement of the actuator results in an initial upward movement of the first piston which results in a reduction in pressure in the first cylinder, conduit and package until the pressure is reduced to a level where the buffer piston is urged downward causing the lower end of the buffer piston push fluid into the conduit before being drawn into the first cylinder, when the supply of fluid in the flexible package is depleted and the supply of fluid in the buffer reservoir is depleted, the first piston is urged downward by reduced pressure in the first cylinder causing the upper end of the first piston to become detached from the actuator.

13. A dispensing station for dispensing a plurality of fluids contained in flexible packages, the station comprising:

a rotary table, the table comprising an outer periphery having a plurality of fluid dispensers disposed around the periphery, the table rotating so that one dispenser is disposed in front of a receiving vessel at a time, the table comprising an actuator for activating the dispenser disposed in front of the receiving vessel, each dispenser comprising a flexible package connected to a first pump by a conduit, the flexible package containing a supply of fluid to be dispensed, the first pump comprising a first cylinder and a first piston, the first piston comprising a lower end and an upper end, the lower end of the first piston being slidably accommodated in the first cylinder, the upper end of the first piston detachably for engaging the actuator, when the fluid is disposed in the package, upward movement of the actuator results in upward movement of the first piston and a drawing of fluid from the package, through the conduit and into the first cylinder, when the supply of fluid in the package is depleted, upward movement of the actuator results in an initial upward movement of the first piston which results in a reduction in pressure in the first cylinder, conduit and package until the pressure is reduced to a level where the first piston is urged downward by reduced pressure in the first cylinder causing the upper end of the first piston to become detached from the actuator.

14. The station of claim 13 wherein the table further comprises a sensor for detecting when the actuator becomes disengaged from its respective first piston, the table rotating the dispenser having the disengaged actuator away from the receiving vessel.

15. The station of claim 13 wherein each conduit of each dispenser comprises a first section connecting the flexible package to a buffer reservoir and a second section connecting the first section to the first pump, the second section being connected to the first section between the flexible package and the buffer reservoir, the buffer reservoir being disposed vertically below the flexible package so that fluid flows downward from the flexible package through the first section of the conduit to the buffer reservoir, and when the supply of fluid in the flexible package is depleted, upward movement of the actuator results in a drawing of fluid from the buffer reservoir, through a portion of the first section of the conduit, through the second section of conduit and into the first cylinder.

16. The station of claim 15 wherein each dispenser further comprises a valve disposed in the first section of the conduit between the flexible package and the second section of the conduit, closure of the valve isolating the flexible package from the buffer reservoir and the first pump thereby enabling the flexible package to be removed from the dispenser either replaced or refilled when the flexible package is empty.

17. The station of claim 16 wherein each dispenser further comprises a coupling that connects the conduit to the flexible package, the valve of each dispenser being located in the coupling of said dispenser.

18. The station of claim 13 wherein each dispenser further comprises a buffer reservoir connected to the conduit between the flexible package and the first pump, the buffer reservoir comprising a buffer supply of fluid, the buffer supply of fluid being isolated from the conduit when fluid is present in the flexible package, when the supply of fluid in the flexible package is depleted, upward movement of the actuator results in an initial upward movement of the first piston which results in a reduction in pressure in the first cylinder, conduit and package until the pressure is reduced to a level where fluid is released from the buffer reservoir into the conduit.

19. The station of claim 18 wherein each dispenser further comprises a valve disposed in the first section of the conduit between the flexible package and the second section of the conduit, closure of the valve isolating the flexible package from the buffer reservoir and the first pump thereby enabling the flexible package to be removed from the dispenser either replaced or refilled when the flexible package is empty.

20. The station of claim 18 wherein each buffer reservoir comprises a buffer pump in communication with the buffer supply of fluid and the conduit, the buffer pump being inactive when fluid is present in the flexible package, the buffer pump being activated when the supply of fluid in the flexible package is depleted and a low pressure atmosphere is created in the conduit by upward movement of the actuator.

21. The station of claim 13 wherein each first cylinder of each dispenser is in communication with an outlet for discharging the fluid, the outlet comprising a hole through which the fluid passes, the outlet being pivotally connected to a scraper for removing excess fluid from the outlet after fluid has passed through the hole.

22. The station of claim 13 wherein each first cylinder of each dispenser is in communication with an outlet for discharging the fluid, the outlet comprising a hole through which the fluid passes, the outlet being pivotally connected to a closure for covering the hole and limiting exposure of the fluid disposed in the first cylinder to air, the pivotal closure further comprising a main body for engaging the hole and a scraper for removing excess fluid from the outlet prior to the engagement of the hole with the main body.

23. A cleaning device for a closure of an outlet of a fluid dispenser, the closure being capable of lateral pivotal movement between a closed position where the closure is disposed over the outlet and an open position where the closure is spaced apart from the outlet, the cleaning device comprising:

a scraper connected to the outlet and extending laterally outwardly therefrom between the closure and the outlet, the scraper engaging the outlet for removing excess fluid from the outlet after fluid has passed through the outlet when the closure pivots from the open position to the closed position, the scraper engaging the outlet prior to the closure when the closure is moved from the open position to the closed position, the scraper being spaced laterally from the outlet when the closure is in the closed position.

24. A combination closure and cleaning device for the outlet of a fluid dispenser comprising:

a main body pivotally connected to the fluid dispenser and laterally adjacent to the outlet, the main body being connected to a scraper that extends laterally outward from the main body, the main body also comprising a sealing ring, the main body pivoting over the outlet so that the scraper engages the outlet and removes fluid from the outlet before the sealing ring of the main body engages the outlet, the scraper being spaced laterally from the outlet when the sealing ring engages the outlet.

25. A method of dispensing a recipe from a rotary dispensing station, the method comprising the following steps:

providing a plurality of different viscous fluids, each fluid being contained in an individual flexible package attached to one of a plurality of dispensers, each dispenser being mounted onto a rotary table, the table comprising an outer periphery having the fluid dispensers disposed around the periphery, the table rotating so that one dispenser with one flexible package is disposed in front of a receiving vessel at a time, the table further comprises an actuator for activating the dispenser disposed in front of the receiving vessel, each dispenser comprising a flexible package connected to a pump by a conduit, rotating the table so that a first dispenser with a first flexible package containing a first viscous fluid is disposed in front of the receiving vessel and the actuator is detachably attached to the upper end of the piston of the first dispenser, moving the actuator upward thereby drawing of fluid from the first flexible package, through the conduit and into the cylinder of the first dispenser, moving the actuator downward to pump fluid from the cylinder of the first cylinder into the receiving vessel, rotating the table so that a second dispenser with a second flexible package containing a second viscous fluid is disposed in front of the receiving vessel and the actuator is detachably attached to the upper end of the piston of the second dispenser, moving the actuator upward thereby drawing of fluid from the second flexible package, through the conduit and into the cylinder of the second dispenser, moving the actuator downward to pump fluid from the cylinder of the second cylinder into the receiving vessel.

26. The method of claim 25 wherein each dispenser further comprises:

a buffer reservoir to the flexible package by the conduit, the buffer reservoir being disposed vertically below the flexible package so that fluid flows downward from the flexible package through said section of the conduit to the buffer reservoir, and when the supply of fluid in the flexible package is depleted, upward movement of the actuator results in a drawing of fluid from the buffer reservoir.

27. The method of claim 25 wherein each dispenser further comprises:

a buffer reservoir comprising a buffer pump in communication with a buffer supply of fluid and the conduit, the buffer pump being inactive when fluid is present in the flexible package, the buffer pump being activated when the supply of fluid in the flexible package is depleted and a low pressure atmosphere is created in the conduit by upward movement of the actuator.

28. A dispenser for dispensing a supply of fluid, the dispenser comprising:

a flexible package accommodating the primary supply of fluid, the flexible package being connected to a conduit, the conduit connecting the flexible package to a buffer reservoir and a pump comprising a cylinder, the cylinder being connected to a piston comprising a lower end and an upper end, the lower end being slidably accommodated in the cylinder, the cylinder being in communication with an outlet, when the fluid is disposed in the flexible package, upward movement of the piston results in a drawing of fluid from the flexible package, through the conduit and into the cylinder below the lower end of the piston, when the supply of fluid in the flexible package is depleted and fluid is disposed on the buffer reservoir, upward movement of the piston results in a drawing of fluid from the buffer reservoir, through the conduit and into the cylinder.

29. A fluid dispenser comprising:

a dispensing body comprising a downwardly directed fluid outlet, the dispensing body further comprising a lower portion pivotally connected to a combination closure and cleaning device, the combination closure and cleaning device pivotally connected to the dispensing body at a position laterally spaced from the outlet, the combination closure and cleaning device comprising a main body which comprises a sealing ring, the main body being connected to a scraper, the main body pivoting between an open position whereby the sealing ring is spaced laterally from the outlet and a closed position whereby the sealing ring engages the outlet, the scraper extending laterally outward from the main body and towards the outlet when the main body is in the open position so that as the main body moves from the open position towards the closed position the scraper engages the outlet before the sealing ring engages the outlet as the main body reaches the closed position.

* * * * *